US006570081B1

(12) United States Patent
Suzuki et al.

(10) Patent No.: US 6,570,081 B1
(45) **Date of Patent: *May 27, 2003**

(54) METHOD AND APPARATUS FOR EDITING PERFORMANCE DATA USING ICONS OF MUSICAL SYMBOLS

(75) Inventors: Hideo Suzuki, Hamamatsu (JP); Masao Sakama, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/663,318

(22) Filed: Sep. 15, 2000

(30) Foreign Application Priority Data

Sep. 21, 1999 (JP) ..... 11-267767

(51) Int. Cl.[7] ..... G10H 1/06; G10H 7/00

(52) U.S. Cl. ..... 84/622; 84/609; 84/626; 84/645

(58) Field of Search ..... 84/600–603, 609, 84/615–619, 622–629, 645, 649, 653–657, 659–663

(56) References Cited

U.S. PATENT DOCUMENTS

| | | | | |
|---|---|---|---|---|
| 5,684,259 A | | 11/1997 | Horii | |
| 5,852,251 A | | 12/1998 | Su et al. | |
| 6,140,566 A | * | 10/2000 | Tamura | 84/609 |
| 6,150,598 A | * | 11/2000 | Suzuki et al. | 84/603 |

FOREIGN PATENT DOCUMENTS

| | | |
|---|---|---|
| EP | 0 484 046 A2 | 5/1992 |
| EP | 0847 039 A1 | 6/1998 |
| EP | 00 12 0484 | 2/2001 |
| JP | 05-127673 | 5/1993 |
| JP | 09-006346 | 1/1997 |
| JP | 10-214083 | 8/1998 |

OTHER PUBLICATIONS

Rideout, E. (1999). "Cakewalk Metro 4.5" *Keyboard* 25(1):84,86, and 88–90.

* cited by examiner

*Primary Examiner*—Marlon T. Fletcher
(74) *Attorney, Agent, or Firm*—Morrison & Foerster LLP

(57) ABSTRACT

A performance date editing system is designed to efficiently convert normal performance data to execution-related performance data with simple operations and without errors. Herein, data portions which are subjected to conversion to execution-related data are extracted from input performance data corresponding to MIDI data. In addition, it is possible to further extract specific types of data, which are related to prescribed musical parameters (or events) such as attack, release, modulation and accent-plus-duration, from the extracted data portions. Hence, the extracted data portions or the specific types of data being further extracted are subjected to conversion to the execution-related data, which are supplied to an execution-related sound source. Herein, a remaining part of the input performance data excluding the extracted data portions is supplied to a normal sound source. Thus, the system is capable of selectively converting specific parts of the input performance data or the specific types of data to the execution-related data. This eliminates possibilities in that unwanted data are mistakenly converted to the execution-related performance data. Incidentally, the conversion is performed in accordance with a prescribed set of conversion rules, which are selected from among plural sets of conversion rules and are editable by users.

19 Claims, 13 Drawing Sheets

METHOD AND APPARATUS FOR EDITING PERFORMANCE DATA USING ICONS OF MUSICAL SYMBOLS

BACKGROUND OF THE INVENTION

1. Field of the Invention

This invention relates to methods and apparatuses for editing performance data in music, and particularly to methods and apparatuses for converting original performance data to execution data (or articulation data, i.e., data regarding symbols, techniques or styles of music performance) using execution icons (or articulation icons). In addition, this invention also relates to recording media storing programs for editing performance data.

This application is based on Patent Application No. Hei 11-267767 filed in Japan, the content of which is incorporated herein by reference.

2. Description of the Related Art

Conventionally, there are provided sound source devices (or execution-related sound sources) that are specially designed to store musical tones and sounds in connection with a variety of executions (i.e., symbols, techniques or styles of music performance) such as glissando and tremolo. Those sound source devices generate musical tone signals of high qualities in connection with the executions being designated. For example, Japanese Unexamined Patent Publication No. Hei 10-214083 discloses a musical tone generation technique in which tune data such as standard MIDI files (or SMF, where "MIDI" designates the known standard for "Musical Instrument Digital Interface") are subjected to analysis to discriminate executions so that the tune data are reproduced to include execution codes.

It is possible to propose a system that installs an execution-related sound source in addition to a normal sound source. Herein, even if the system receives data of multiple channels, the system is not limited in such a way that all the data of the multiple channels are supplied to the execution-related sound source, so that a part of the data is supplied to the normal sound source. Conventionally, however, the existing systems are designed such that all data are directly converted to execution data.

There is a probability in that the tune data include data which are irrelevant t o the executions). Due to such data, there is a possibility in that operational errors are caused to occur in conversion to the execution data. There are prescribed conversion rules how to convert original tune data to execution data. Conventionally, however, composers (e.g., users) are not allowed to control (or change) the conversion rules in the conventional systems.

SUMMARY OF THE INVENTION

It is an object of the invention to provide a performance data editing system that is capable of efficiently converting only necessary parts of normal performance data to execution related performance data with simple operation s and without errors.

It is another object of the invention to provide a performance data editing system by which a human operator or user is capable of changing conversion rules in conversion to execution data with ease.

According to a first aspect of the invention, there is provided a performance data editing system which is configured by an input device for inputting performance data (e.g., MIDI data), an extraction device for extracting at least one data portion (or part) from the input performance data and a conversion device for converting the extracted data portion to execution-related data. Namely, the system is capable of converting only a necessary part of normal performance data to execution-related data, which is supplied to an execution-related sound source. In addition, a remaining part of the normal performance data is supplied to a normal sound source.

According to a second aspect of the invention, there is provided a performance data editing system which is configured by an input device for inputting performance data (e.g., MIDI data), a designation device for designating specific types of data within the input performance data and a conversion device for converting the designated specific types of data to execution-related data. Herein, the specific types of data are related to prescribed musical parameters (or events) such as attack, release, modulation and accent-plus-duration. Namely, the system is capable of converting only the specific types of events of tune data to execution-related data, wherein the designation device is capable of defining a relationship between specific types of events and their corresponding execution-related data (or execution icons, articulation icons) being produced by conversion.

According to a third aspect of the invention, there is provided a performance data editing system in which the designation device is capable of selecting a desired set of conversion rules from among plural sets of conversion rules which are stored in advance for conversion from the specific types of data to the corresponding execution-related data. In addition, the system also includes an editing device for editing the conversion rules under operations of users.

BRIEF DESCRIPTION OF THE DRAWINGS

These and other objects, aspects and embodiment of the present invention will be described in more detail with reference to the following drawing figures, of which.

DESCRIPTION OF THE PREFERRED EMBODIMENT

This invention will be described in further detail by way of examples with reference to accompanying drawings.

[A] Hardware Configuration

Figure 1:
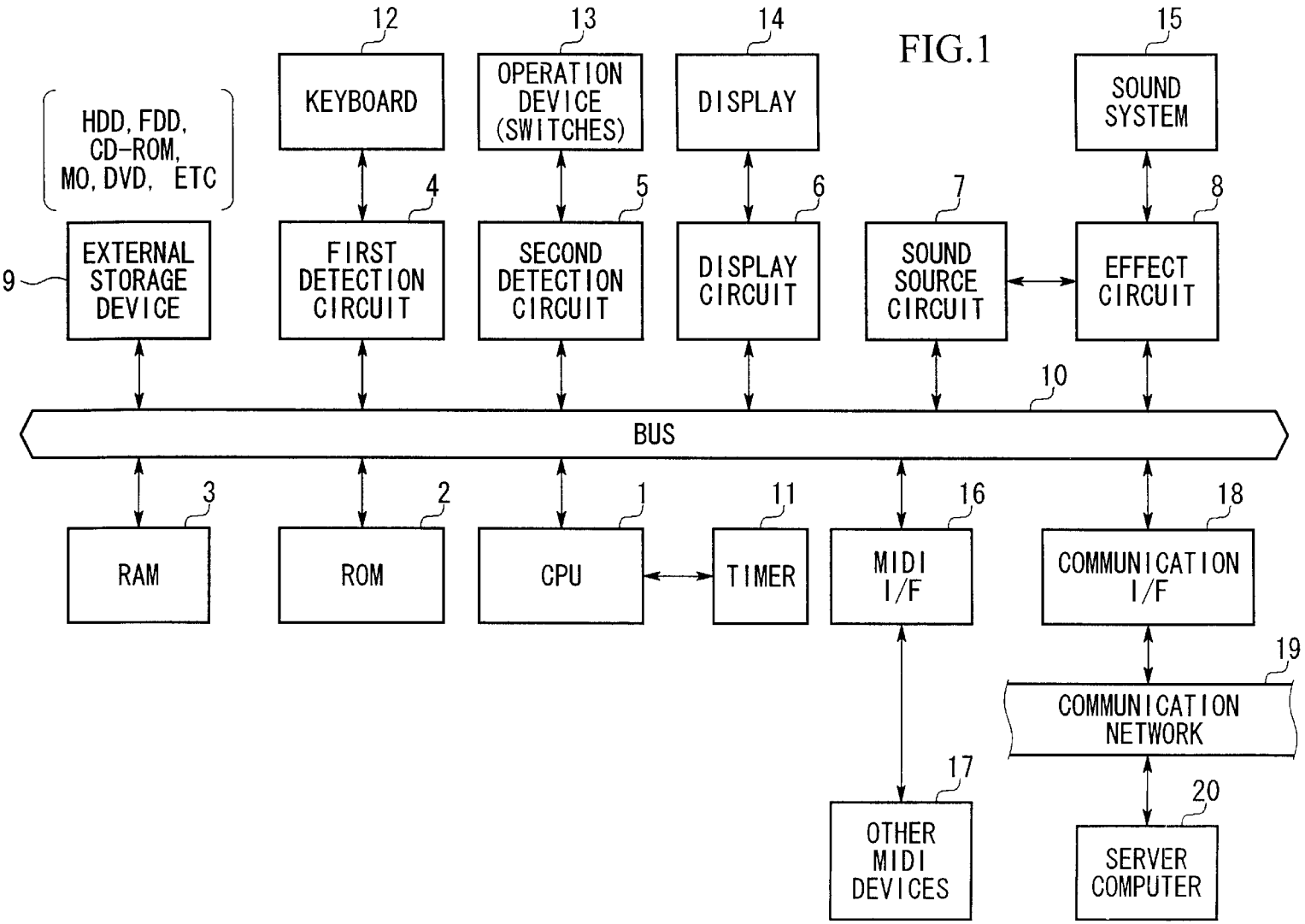
FIG. 1 is a block diagram showing a hardware configuration of a performance data editing system in accordance with preferred embodiment of the invention.

FIG. 1 is a block diagram showing a hardware configuration of a performance data editing system in accordance with the preferred embodiment of the invention. In FIG. 1, the performance data editing system installs a central processing unit (CPU) 1, a read-only memory (ROM) 2, a random-access memory (RAM) 3, first and second detection circuits 4, 5, a display circuit 6, a sound source circuit 7, an effect circuit 8 and an external storage device 9. Those circuits and devices are mutually interconnected with each other by way of a bus 10.

The CPU 1 performs overall controls on the system and is connected with a timer 11, which is used to generate tempo clock pulses and interrupt clock pulses, for example. That is, the CPU 1 performs a variety of controls in accordance with prescribed programs and pivotally executes performance data editing processes in accordance with this invention. The ROM 2 stores prescribed control programs for controlling the performance data editing system. Roughly speaking, the control programs are directed to basic performance data editing operations. In addition, the control programs include a variety of processing programs, data and tables with regard to the performance data editing operations. The RAM 3 stores data and parameters which are needed for execution of the aforementioned processes. A storage area of the RAM 3 can be used as a work area for temporarily storing a variety of data being processed.

The first detection circuit 4 is connected with a keyboard (or keyboard device) 12, while the second detection circuit 5 is connected with an operation device 13 that corresponds to panel switches, a mouse, etc. The display circuit 6 is connected with a display 14. So, a human operator (e.g., user or composer) is capable of operating the devices 12, 13 while watching visual images and characters being displayed on various types of screens of the display 14. The effect circuit 8 is configured by a digital signal processor (DSP) or else and is connected with a sound system 15. The sound system 15 cooperates with the sound source device 7 and the effect circuit 8 to configure a musical tone output section, which contributes to generation of musical tones based on various types of performance information including performance data before and after execution of processes of the performance data editing system.

The external storage device 9 is configured by a desired storage selected from among a hard-disk drive (HDD), a compact-disk drive, a CD-ROM drive, a floppy-disk drive (FDD), a magneto-optic (MO) disk drive and a digital-versatile-disk (DVD) drive, for example. Namely, the external storage device 9 is capable of storing a variety of control programs and data. Therefore, the performance data editing system of FIG. 1 is not necessarily limited in specification in that the ROM 2 is solely used for storage of processing programs and data which are needed for execution of the performance data editing operations. In addition, it is possible to operate the system such that the RAM 3 loads the programs and data from the external storage device 9. Further, processing results can be stored in the external storage device 9 according to needs.

The performance data editing system of the present embodiment has a capability of communicating with other MIDI devices 17 by way of a MIDI interface (MIDI I/F) 16, which is connected to the bus 10. The system is not necessarily limited in use of the MIDI interface 16 specially designed therefor. So, it is possible to use other general-use interfaces such as interfaces for RS-232C, universal serial bus (USB) and IEEE 1394 serial bus (where "IEEE" is an abbreviation for "Institute of Electrical and Electronics Engineers"). In this case, the system can be modified to simultaneously transmit or receive data other than MIDI messages. The bus 10 is also connected with a communication interface 18, which is being connected with a server computer 20 via a communication network 19. Hence, a variety of processing programs and data from the server computer 20 can be downloaded to the system, in which they are stored in the external storage device 9.

A typical example of the performance data editing system of this invention can be actualized by an electronic musical instrument which installs the keyboard 12 and operation device 13 as shown in FIG. 1. However, the system can be also actualized by a personal computer that installs software such as application programs for editing performance data, for example. In addition, the system is applicable to equipment or machine that creates tune data regarding musical tunes such as popular songs being played with orchestra sounds for karaoke apparatuses. Further, the system is applicable to player pianos that play automatic performance of piano sounds. Incidentally, the electronic musical instruments used for actualization of the system are not necessarily limited to keyboard instruments, hence, they can be designed in other forms such as stringed instruments, wind instruments and percussion instruments. The sound source circuit 7 is not necessarily configured as a hardware sound source, hence, it can be configured as a software sound source. In addition, functions of the aforementioned musical tone output section (i.e., 7, 8, 15) including sound source functions are not necessarily placed under controls of the present system, hence, they can be placed under controls of the other MIDI devices 17 by using MIDI tools or communication tools of networks, for example.

[B] Outline of Performance Data Editing Functions

Figure 2:
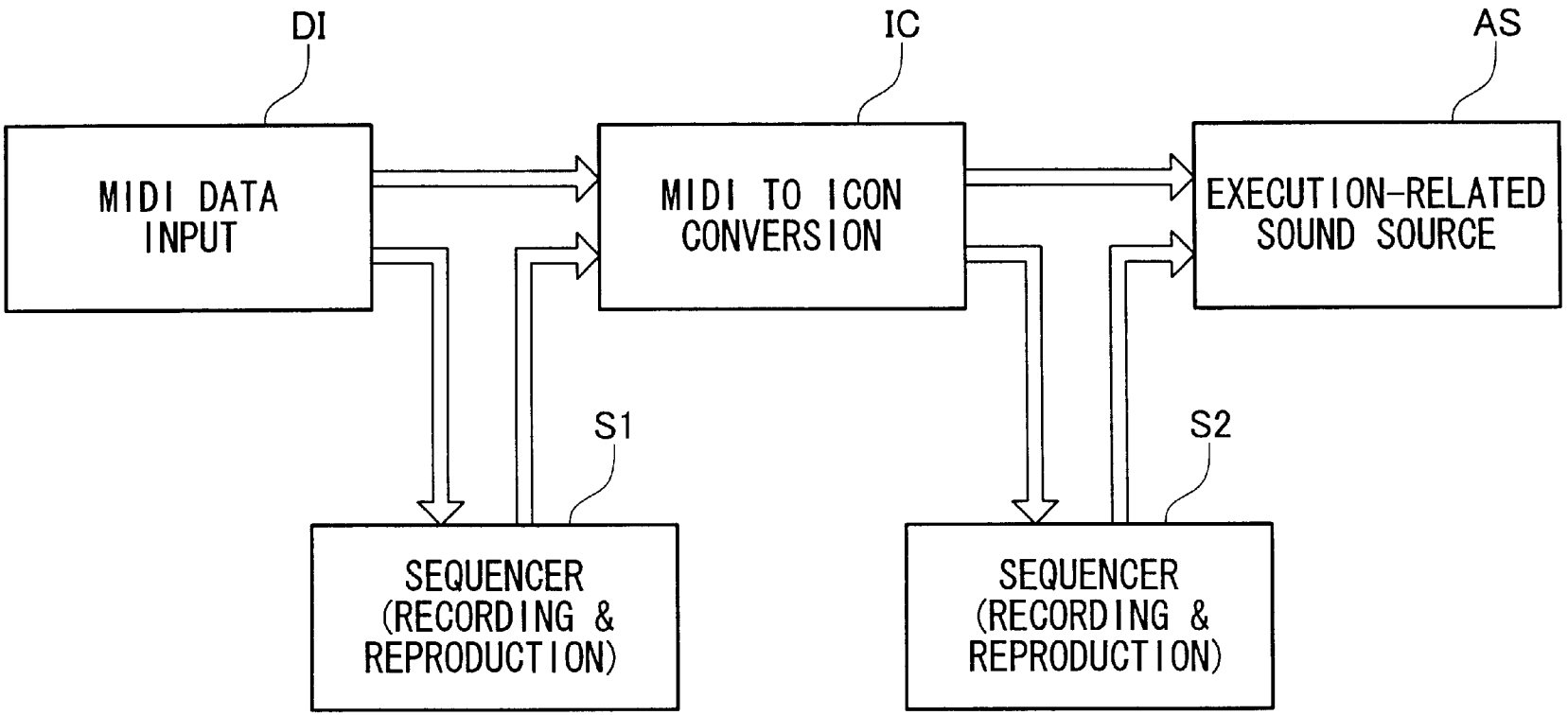
FIG. 2 is a simplified functional block diagram showing an outline of processing of the performance data editing system.

FIG. 2 is a block diagram showing an outline of performance data editing functions in accordance with the present embodiment. In FIG. 2, a MIDI data input block DI deals with real-time inputs and step inputs by which performance data are input to the system. Normally, the performance data are MIDI data. For example, the system inputs performance data by real-time performance (on the keyboard 12) as "real-time MIDI data". Or, the system inputs performance data by reading in SMF data such as "real-time MIDI data files (SMF)" which are temporarily stored and "expression-enhanced MIDI data files (SMF)" which are created by processing MIDI data of step inputs such that expressions are enhanced with respect to tone-generation timings, lengths, volumes and pitch bends.

There are two types of real-time performance inputs, as follows:

(1) The system newly inputs plural kinds of MIDI data by real-time performance.

(2) The system inputs new MIDI data by real-time performance while reproducing MIDI data (e.g., note data) previously input.

As for the first type (1) of the real-time performance input, the system simultaneously inputs MIDI data (e.g., pitch bends and expressions) corresponding to plural kinds of execution icons, or the system successively inputs MIDI data (e.g., pitch bends only) corresponding to a single execution icon. Namely, the system conducts real-time performance input in desired manners. In contrast, the system newly reads in all data with regard to the SMF data.

The MIDI data input block DI is given data extraction functions such as a channel filtering function and a message filtering function. Those data extraction functions are adequately applied to the system according to needs. According to the channel filtering function, input MIDI data are subjected to filtering (or selection) in channel(s) by using a MIDI channel filter, which contributes to deletion of unwanted MIDI data other than MIDI data of a designated MIDI channel. That is, if designation set a MIDI channel to a specific value (e.g., "1"), it is possible to obtain MIDI data of a specific channel (e.g., channel 1), for example.

According to the message filtering function, input MIDI data or filtered MIDI data being filtered by channel filtering are subjected to filtering (or selection) in events by using a MIDI message filter, which contributes to deletion of unwanted MIDI data other than MIDI data of designated MIDI events. For example, it is possible to designate prescribed MIDI events of MIDI messages such as "note event (i.e., note-on event, note-off event, note number, velocity)", "pitch bend", "modulation", "expression" and "after-touch". In that case, other MIDI messages are deleted by filtering, so that they are not transferred from the MIDI data input block DI to a "MIDI-to-icon" conversion block IC.

MIDI performance data being extracted by the MIDI data input block DI are directly supplied to the MIDI-to-icon conversion block IC, or they are indirectly supplied to the MIDI-to-icon conversion block IC via a sequencer S1 in which they are temporarily recorded and then reproduced. The MIDI-to-icon conversion block IC has a basic conversion function (hereinafter, referred to as a function of "MIDI-to-icon conversion") by which the input MIDI performance data are converted to execution-related icon data representing execution icon events.

In addition to the MIDI-to-icon conversion function, the MIDI-to-icon conversion block IC has a time section designation function, which is adequately applied to the system according to needs. Herein, a human operator (or user) operates the operation device 13 such as the mouse to designate a time section for a conversion subject of MIDI data on a screen of the display 14. According to the time section designation function, input MIDI data or filtered MIDI data, which are filtered by the channel filtering and message filtering, are subjected to MIDI-to-icon conversion with respect to the designated time section.

The MIDI-to-icon conversion operates in multiple conversion modes as follows:

(a) Non-conversion mode as to notes plus a message of "execution icon conversion is not made".

(b) Collective conversion mode as to notes plus a message of "collective conversion is made by all execution icon layers".

(c) Successive conversion mode as to notes plus a message of "successive conversion is made by each execution icon layer being designated".

The user is capable of designating each of the conversion modes by operating a specific button with the operation device 13 while watching a conversion dialogue window displayed on the screen of the display 14. Incidentally, the MIDI-to-icon conversion converts specific types of data to various execution icons, which are collected together as a group corresponding to the execution icon layer. In the successive conversion mode, the system uses a layer filtering function for the MIDI-to-icon conversion by use of the execution icon layer being selected.

In the collective conversion mode and successive conversion mode, the MIDI-to-icon conversion independently applies a noise component elimination process and a characteristic extraction process on specific kinds of MIDI data such as pitch bend and modulation, then, execution icon parameters are being calculated.

In summary, the MIDI data input block DI selects from among input performance data the data portions which should be converted to execution data, so that the selected data portions (i.e., selected performance data) are supplied to the MIDI-to-icon conversion block IC. In response to designation of the time section and/or designation of a specific type of data, the MIDI-to-icon conversion block IC extracts designated data portions from the selected performance data, then, it converts only the extracted data portions or the specific type of data to execution icon events. Thus, the MIDI-to-icon conversion block IC produces execution-related events containing the execution icon events. The execution-related events are directly supplied to an execution-related sound source AS, or they are indirectly supplied to the execution-related sound source AS via a sequencer S2 in which they are temporarily recorded and then reproduced. Based on the execution-related icon events, the sequencer S2 contributes to display of execution icons on a musical score.

The execution-related events are mainly configured by note events, execution icon events and time data. The note events are configured by note information and note parameter information (velocity, gate time, etc.), while the execution icon events are configured by execution icon ID information and execution icon parameters. Incidentally, the time data indicate times of occurrence of events.

Upon receipt of the execution-related events containing the note events and execution icon events, the execution-related sound source AS generates musical tone signals representing note events to which articulation corresponding to the execution icon events is imparted.

Incidentally, details of the execution-related sound source AS are disclosed by Japanese Unexamined Patent Publication No. Hei 10-214083, which is discussed before.

[C] Concept of MIDI-to-icon Conversion

Figure 3:
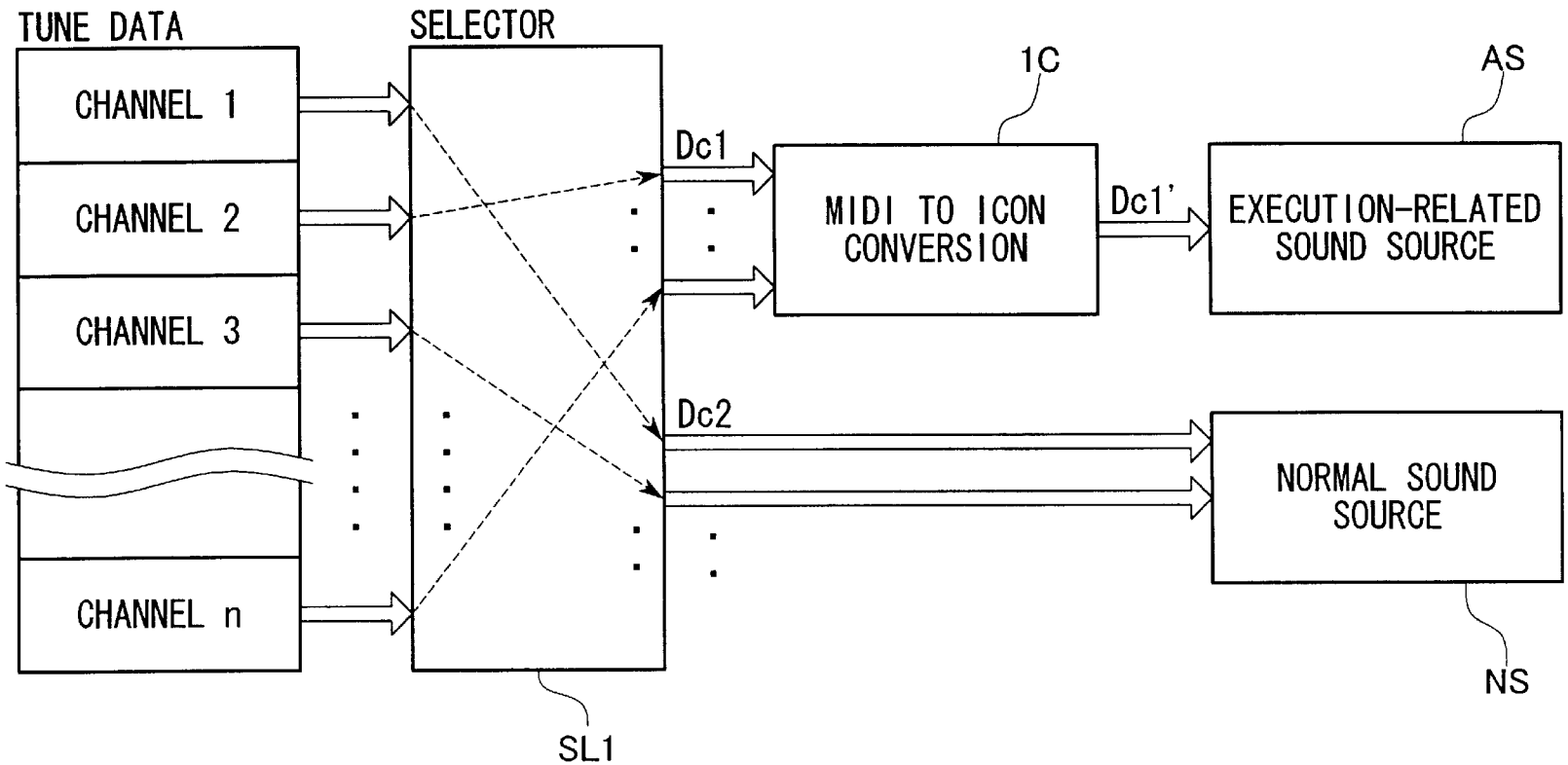
FIG. 3 is a conceptual block diagram for explaining a first conversion mode in which MIDI-to-icon conversion is performed selectively on a part of tune data by using a channel filtering function in the performance data editing system.

FIG. 3 is a conceptual block diagram for explaining a first conversion mode in which MIDI-to-icon conversion is performed selectively on a part of tune data by using a channel filtering function in the performance data editing system of the present embodiment. Herein, the tune data include MIDI data of plural channels (or plural parts) 1 to n. That is, a channel selector SL1 is controlled by the operation device 13 which is operated by a user to designate a specific MIDI channel, so that a part Dc1 of the tune data is being selected.

The MIDI-to-icon conversion block IC performs MIDI-to-icon conversion selectively on the part Dc1 of the tune data being selected by the channel selector SL1, thus producing converted data Dc1', which is supplied to the execution-related sound source AS. A remaining part Dc2 of the tune data which is not selected by the channel selector SL1 is supplied to a normal sound source NS as non-conversion data Dc2. In this case, it is possible to provide intervention of the sequencer as shown in FIG. 2. That is, the converted data Dc1' and non-conversion data Dc2 are temporarily recorded on the sequencer, then, they are reproduced and supplied to the sound sources AS, NS respectively.

Figure 4:
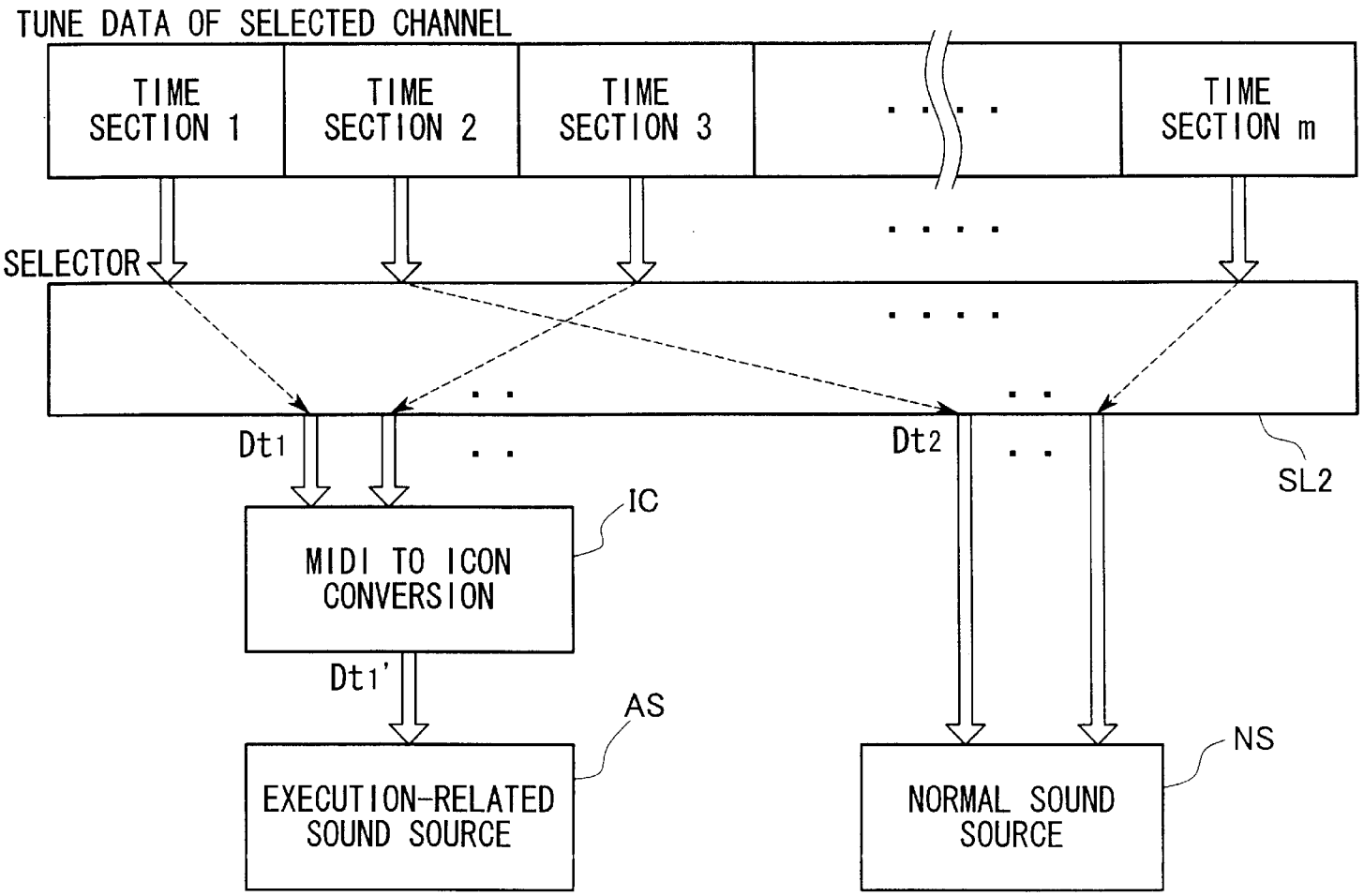
FIG. 4 is a conceptual block diagram for explaining a second conversion mode in which MIDI-to-icon conversion is performed selectively on a part of tune data by using a time section designation function in the performance data editing system.

FIG. 4 is a conceptual block diagram for explaining a second conversion mode in which MIDI-to-icon conversion is performed selectively on a part of tune data by using a time section designation function in the performance data editing system of the present embodiment. Herein, there are provided tune data of plural channels 1 to n, among which tune data of a certain channel is selected. In FIG. 4, the tune data of the selected channel is divided into plural time sections 1 to m with respect to time. Concretely speaking, MIDI data which is subjected to conversion are displayed on the screen of the display 14, then, the user operates the operation device 13 such as the mouse to designate a desired time section. This activates a time section selector SL2 to select data Dt1 corresponding to a certain time section being selected from among plural time sections 1 to m, for example.

The MIDI-to-icon conversion block IC performs MIDI-to-icon conversion on the data Dt1 of the selected time section, thus producing converted data Dt1', which is supplied to the execution-related sound source AS. Data Dt2 of remaining time sections which are not selected by the time section selector SL2 are supplied to the normal sound source NS as non-conversion data Dt2. In this case, it is possible to provide intervention of the sequencer as shown in FIG. 2. That is, the converted data Dt1' and non-conversion data Dt2 are temporarily recorded on the sequencer, then, they are reproduced and supplied to the sound sources AS, NS respectively.

Figure 5:
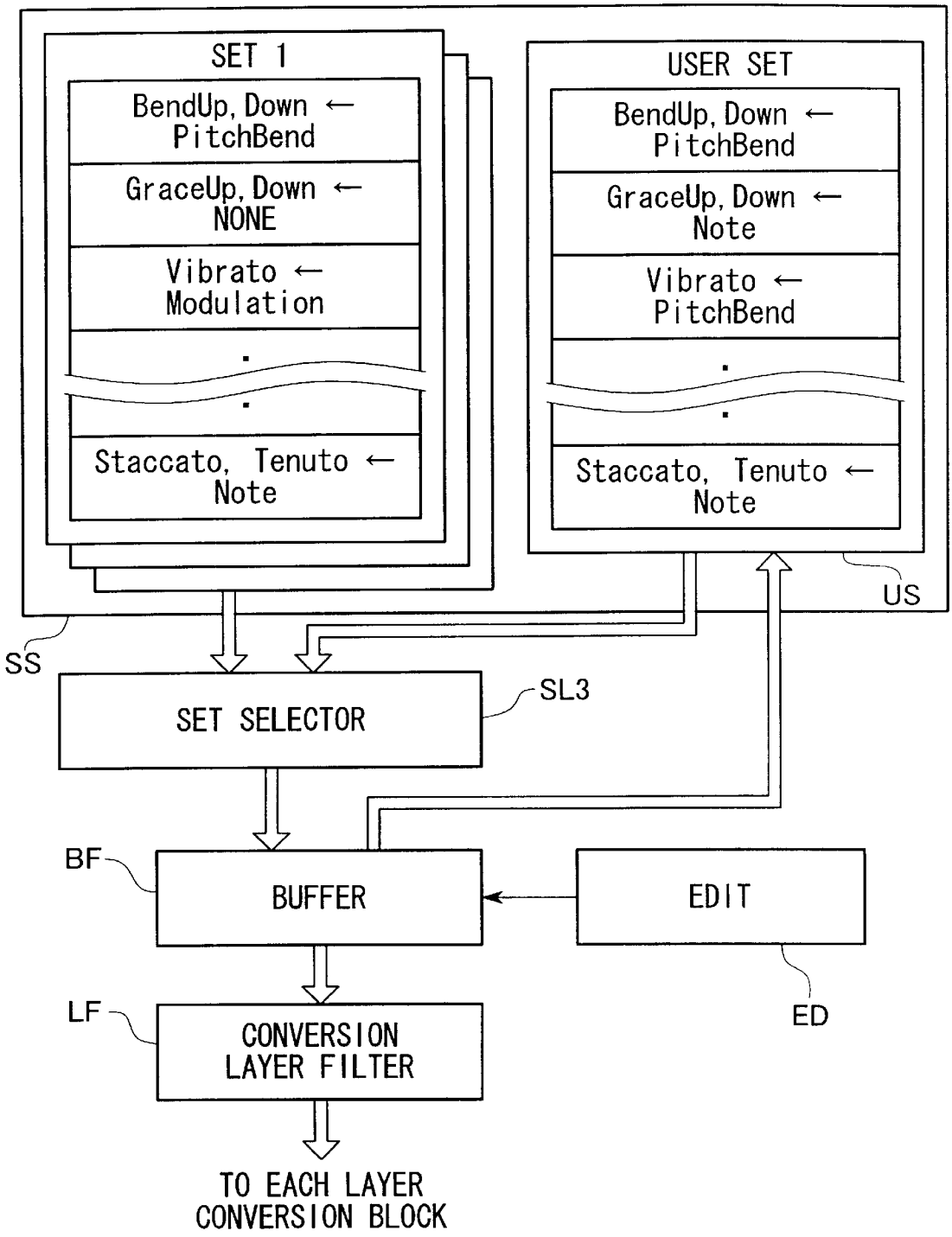
FIG. 5 is a conceptual block diagram for explaining a third conversion mode in which MIDI-to-icon conversion is performed selectively on a part of specific types of data in the performance data editing system in accordance with a selected set of conversion rules.
Figure 6:
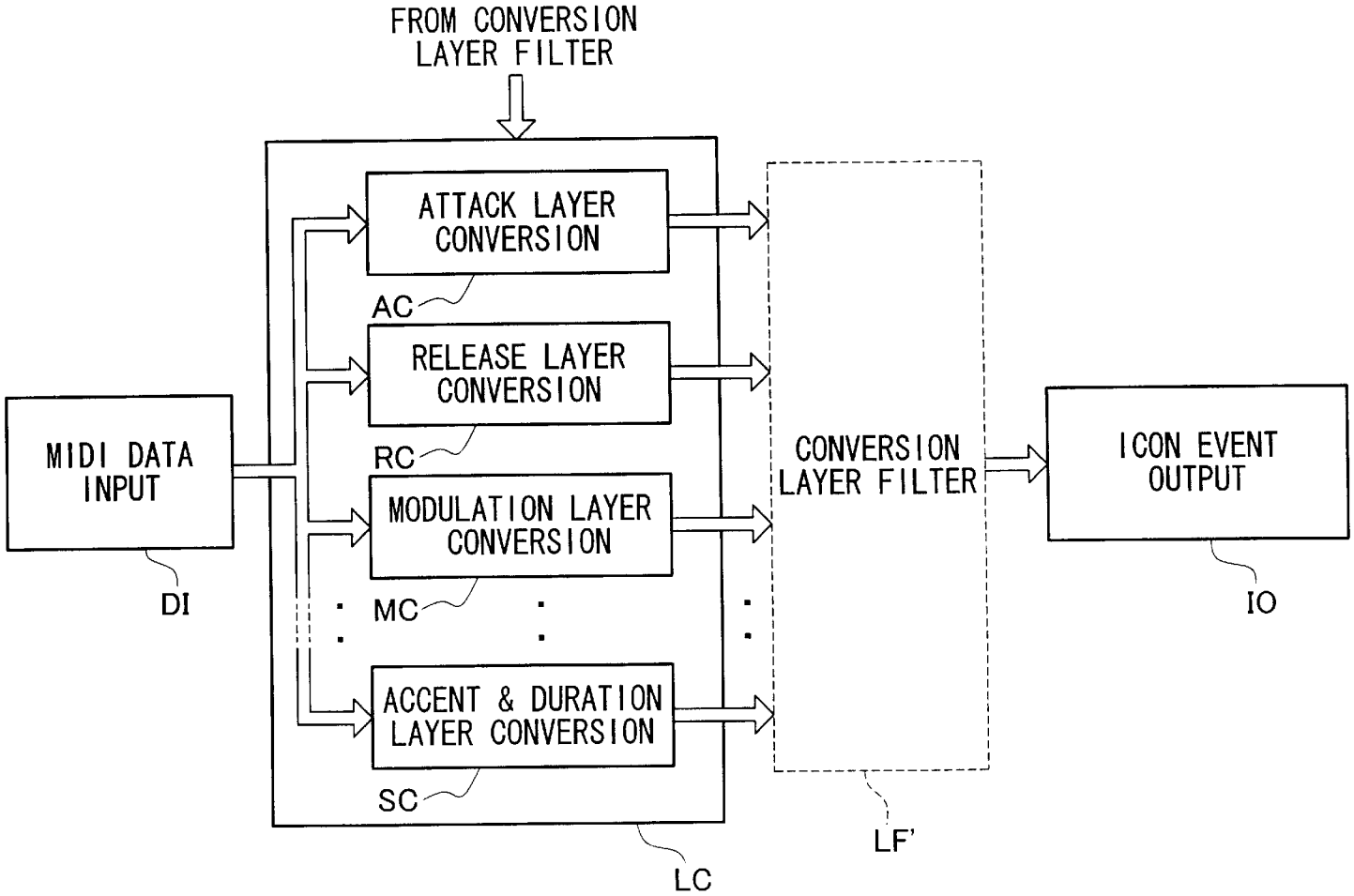
FIG. 6 is a conceptual block diagram for explaining a fourth conversion mode in which MIDI-to-icon conversion is performed selectively on a part of specific types of data by using a layer filtering function in the performance data editing system.

FIGS. 5 and 6 are conceptual block diagrams for explaining third and fourth conversion modes in which MIDI-to-icon conversion is performed selectively on a part of specific types of data by using a layer filtering function in the performance data editing system of the present embodiment. In FIG. 6, MIDI data input by the MIDI data input block DI are classified into specific types of data respectively corresponding to multiple execution icon layers with respect to musical parameters such as attack, release, modulation, accent & duration, etc. As described before, the execution icon layers correspond to groups of execution icons which are obtained through the MIDI-to-icon conversion. Herein, one of the specific types of data is selected and is selectively subjected to MIDI-to-icon conversion via an icon layer conversion block LC.

The icon layer conversion block is configured by an attack layer conversion block AC, a release layer conversion block RC, a modulation layer conversion block MC, an accent & duration layer conversion block SC, etc. Each of the layer conversion blocks AC, RC, MC, SC, etc. is connected with a conversion layer filter LF (see FIG. 5) or a conversion layer filter LF' (see FIG. 6).

As shown in an upper section of FIG. 5, a MIDI-to-execution-icon conversion set SS is provided to enable the MIDI-to-icon conversion being selectively performed on a part of the specific types of data. The MIDI-to-execution-icon conversion set SS defines relationships by which different types of data within the MIDI data are respectively related to different types of execution icons, so that each type of data is being converted to its corresponding type of the execution icon. The MIDI-to-execution-icon conversion set SS corresponds to multiple sets 1, 2, . . . and a user set US, which are stored in a prescribed storage area of the external storage device 9. FIG. 5 shows an example of content of the set 1 consisting of plural columns, each of which defines its own execution icons in an upper section and subject data for conversion in a lower section. For example, a first column defines that pitch bend data of MIDI data is converted to an icon of "bend-up/down". In a second column, "none" is described as the subject data, so that no conversion is made with respect to an icon of "grace-up/down".

In response to a set selecting operation of the operation device 13, a set selector SL3 is activated to select any one of the aforementioned sets in the MIDI-to-execution-icon conversion set SS, so that the selected set is temporarily stored in a buffer BF. In response to a layer selecting operation of the operation device 13, the conversion layer filter LF is activated to select a desired execution icon layer. That is, the conversion layer filter LF has a function of selecting from among the plural execution icon layers (e.g., attack icon layer, release icon layer, etc.) a desired execution icon layer on which MIDI-to-icon conversion is to be performed.

In the present embodiment, the MIDI-to-icon conversion defines types of execution icons being converted with respect to each execution icon layer. For example, the attack icon layer is related to execution icons of bend-up/down and grace-up/down. If the user selects the set 1 while the attack icon layer allows MIDI-to-icon conversion, the conversion layer filter LF activates the attack layer conversion block AC (see FIG. 6) so that on the basis of the content of the selected set 1, pitch bend data of MIDI data is selected as a subject to the MIDI-to-icon conversion. Thus, the pitch bend data is converted to an execution icon of bend-up/down, which is supplied to an icon event output block IO as execution icon data.

As described above, types of data being converted by the icon layer conversion block LC are adequately selected in response to contents of the MIDI-to-execution-icon conversion set SS. In case of FIG. 5, the conversion layer filter LF is provided as an activator for activating the layer conversion blocks AC, RC, MC, SC respectively. Instead of the configuration of FIG. 5, it is possible to propose a configuration of FIG. 6, in which the conversion layer filter LF' (encompassed by a dotted line) is provided as an output controller for controlling outputs of the layer conversion blocks AC, RC, MC, SC respectively. In this case, each layer conversion block (e.g., AC, SC) performs MIDI-to-icon conversion in response to the content of the conversion set temporarily stored in the buffer BF. MIDI data regarding the layer conversion block(s) which is not activated are directly transmitted by the conversion layer filter LF' without conversion.

The present embodiment provides an edit block ED (see FIG. 5) by which it is possible to correct the content of the conversion set temporarily stored in the buffer BF. The corrected content of the conversion set can be stored as the user set US. Herein, it is possible to propose the user set US as a desired conversion set being selected from the MIDI-to-execution-icon conversion set SS, wherein the user set US is read and temporarily stored in the buffer BF by way of the set selector SL3. Incidentally, it is possible to re-design the MIDI-to-execution-icon conversion set SS such as to store plural user sets US.

[D] Procedures of MIDI-to-icon Conversion

Figure 7:
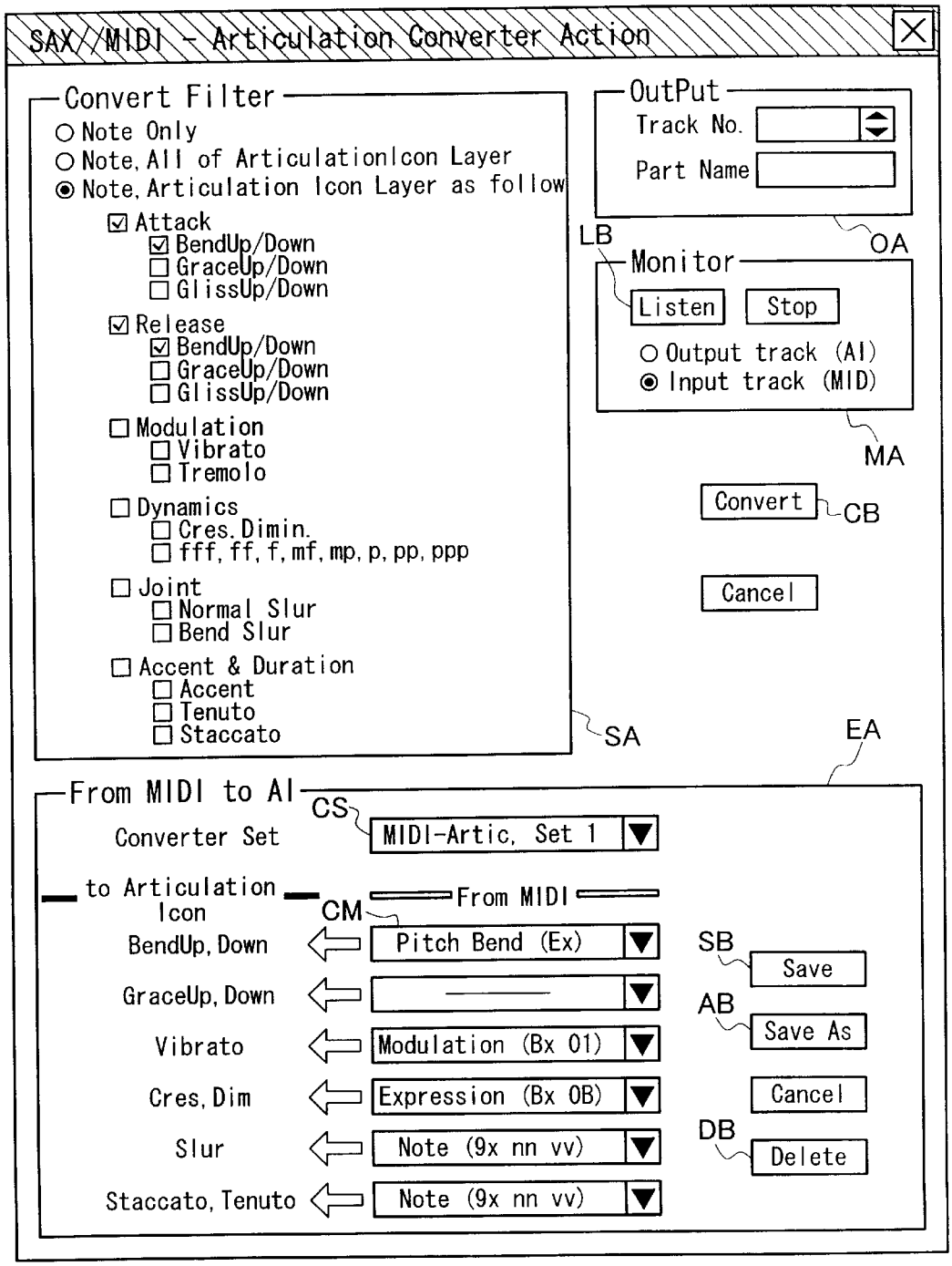
FIG. 7 shows an example of a conversion dialogue window being displayed on a screen of the performance data editing system.

Next, a description will be given with respect to procedures of the MIDI-to-icon conversion which is performed by the MIDI-to-icon conversion block IC. When the user designates the MIDI-to-icon conversion, the display 14 displays on the screen a conversion dialogue window, an example of which is shown in FIG. 7. Concretely speaking, FIG. 7 shows an example of the conversion dialogue window for a specific musical instrument of a saxophone. Details of procedures in operations of the MIDI-to-icon conversion will be described below with reference to FIG. 7.

In the conversion dialogue window of FIG. 7, a mode selection area ("Converter Filter") SA describes three modes, i.e., a non-conversion mode ("Note Only"), a collective conversion mode ("Note, All of Articulation Icon Layer") and a successive conversion mode ("Note, Articulation Icon Layer as follow"), each of which is preceded by a mode selection box "○". In FIG. 7, the successive conversion mode is designated, so that the display 14 displays on the screen its selectable execution icon layers (e.g., Attack, Release, . . . , Accent & Duration), each of which is preceded by execution icon layer selection box "≡". In addition, each of the execution icon layers is related to plural execution icons (e.g., BendUp/Down, GraceUp/Down), each of which is preceded by an output icon selection box "≡". Thus, the user operates the operation device 13 such as the mouse to check a mode selection box "○" to designate a desired conversion mode, then, the user clicks a conversion button ("Convert") CB with the mouse so that MIDI-to-icon conversion is carried out in response to the designated mode.

If the user selects the successive conversion mode as shown in FIG. 7, the user checks the execution icon layer selection box to select a desired execution icon layer for conversion and also checks the output icon selection box to set a desired execution icon. The present embodiment provides a number of selectable execution icon layers, examples of which are described together with their execution icons (followed by arrows "→"), as follows:

(1) Attack execution icon layer→bend-up/down, grace-up/down, glissando-up/down.
(2) Release execution icon layer→bend-up/down, grace-up/down, glissando-up/down.
(3) Modulation execution icon layer→vibrato, tremolo.
(4) Dynamics execution icon layer→Crescendo-Diminuendo, loud/soft symbols (e.g., fortissimo, pianissimo) such as fff, . . . , ppp.
(5) Accent & Duration execution icon layer→Accent, Tenuto, Staccato.
(6) Joint execution icon layer→Normal Slur (Legato), Bend Slur.
(7) Tempo execution icon layer→Ritardando, A Tempo.

The MIDI-to-icon conversion produces execution-related event information, which is configured by note events, execution icon events and time data. The note events are configured by note data, velocity data and gate time data. The execution icon events are configured by execution icon IDs and execution icon parameters. The aforementioned execution icons, which are followed by arrows in the aforementioned paragraphs (1) to (7) regarding the execution icon layers, are output in response to execution icon ID data. The execution icon parameters represent icon parameter values of the execution icons on which corresponding events occur. There are provided a variety of execution icon parameters with regard to execution time data representing execution occurrence times and execution end times, execution lengths, break-point times and depths. As the time data representing occurrence times of events respectively, it is possible to use event interval times (or delta times) each of which represents a time interval between a present event and a previous event corresponding to a note event, an execution icon event or else. So, the time data are described based on a SMF format. Incidentally, the execution-related events may include other original data such as pitch bends and modulations, which are not selected as subjects to the MIDI-to-icon conversion.

The conversion dialogue window of FIG. 7 regarding the saxophone provides selection with respect to six execution icon layers (1) to (6). Concretely speaking, FIG. 7 shows that the user presently checks two layer selection boxes regarding the attack execution icon layer and release execution icon layer and also checks their output icon selection boxes regarding the execution icons of bend-up/down. When the user operates the conversion button CB, the MIDI-to-icon conversion is adequately performed in accordance with the aforementioned setting. Thus, it produces note events together with corresponding execution icon events.

On the conversion dialogue window, it is possible to set an output destination of the execution icons, which are produced by the MIDI-to-icon conversion, by using an output setting area ("OutPut") OA, which shows columns for a track number and a part name. That is, the user is capable of inputting a track number into an upper column to designate a track on which the execution icon events are being output. In addition, the user is capable of inputting a part name into a lower column to designate a part which corresponds to an output destination.

The conversion dialogue window also shows a monitor audition area ("Monitor") MA, by which the user is capable of listening to sounds of MIDI data before conversion as well as sounds of execution-related data after conversion by audition. The monitor audition area MA indicates two check boxes with respect to the MIDI data before conversion ("Input track") and the execution-related data after conversion ("Output track"), one of which is being checked and designated by the user. That is, when the user operates a listen button ("Listen") LB provided in the monitor audition area MA, the aforementioned musical tone output section (7, 8, 15) of the system produces musical tones based on the MIDI data before conversion or execution-related data after conversion in accordance with designation of "Input track" or "Output track".

[E] Details of MIDI-to-execution-icon Conversion Set SS

The MIDI-to-execution-icon conversion set SS defines input/output relationships between the MIDI data being subjected to conversion and the execution icons being produced by the conversion. Hence, a prescribed storage area of the ROM 2 or external storage device 9 stores in advance plural MIDI-to-execution-icon conversion sets, which are set in response to musical instruments being designated. In order to activate the MIDI-to-icon conversion, the user performs a set selection operation on the operation device 13 so that a desired MIDI-to-execution-icon conversion set corresponding to a specific musical instrument is selectively read out on the conversion dialogue window displayed on the screen of the display 14. Thus, the user is capable of editing content of the MIDI-to-execution-icon conversion set being read out on the conversion dialogue window. In order to do so, the conversion dialogue window of FIG. 7 provides an input/output selection area ("From MIDI to AI") EA, which contains a conversion set name column CS for the MIDI-to-execution-icon conversion set and plural data name columns CM for MIDI data of tune data.

The MIDI-to-execution-icon conversion set SS corresponding to the designated musical instrument can be selected by using the conversion set name column CS. Hence, contents of the input/output relationships defined by the selected MIDI-to-execution-icon conversion set are reflected on the data name columns CM, by which the user is capable of visually recognizing the concrete content of the selected MIDI-to-execution-icon conversion set.

With respect to the musical instrument of saxophone, for example, the prescribed storage area of the ROM 2 or external storage area 9 stores in advance three types of MIDI-to-execution-icon conversion sets (1) to (3). FIG. 7 shows that the input/output selection area EA indicates contents of "MIDI-to-execution-icon conversion set 1 (saxophone)", as follows:

(1) MIDI-to-execution-icon conversion set 1 (saxophone)

(a) Bend-up/down pitch←bend.

(b) Grace-up/down←none (which indicates that no conversion is made on the corresponding execution icon).

(c) Vibrato←modulation.

(d) Crescendo-diminuendo←expression.

(e) Slur←note.

(f) Staccato, tenuto←none.

(2) MIDI-to-execution-icon conversion set 2 (saxophone)

(a) Bend-up/down←pitch bend.

(b) Grace-up/down←note.

(c) Vibrato←modulation.

(d) Crescendo-diminuendo←after-touch.

(e) Slur←note.

(f) Staccato, tenuto←none.

(3) MIDI-to-execution-icon conversion set 3 (saxophone)

(a) Bend-up/down←none.

(b) Grace-up/down←none.

(c) Vibrato←pitch bend.

(d) Crescendo-diminuendo←velocity.

(e) Slur←note.

(f) Staccato, tenuto←none.

The present embodiment allows the user to perform a variety of editing operations, such as save and delete in addition to correction of input/output relationships, with respect to the MIDI-to-execution-icon conversion set SS being selectively read out on the input/output selection area EA of the conversion dialogue window displayed on the screen of the display 14. For example, the user is capable of correcting a name of the MIDI-to-execution-icon conversion set shown in the conversion set name column CS as well as names (or types) of parameters of tune data shown in the data name column CM.

Each of musical instruments is related to a different type of "convertible" MIDI data which can be converted to execution icons. In addition, the convertible MIDI data can be selected from among a prescribed range of MIDI data which are set for the execution icons being designated in advance. That is, a composer (i.e., user) is capable of performing the conversion with preferable variations within a prescribed range of executions. In the case of saxophone, certain "selectable" MIDI data being selected in the data name columns CM of tune data are predetermined in connection with the execution icons which are produced by the conversion. Examples are listed below.

(a) Bend-up/down←pitch bend.

(b) Grace-up/down←note, pitch bend.

(c) Vibrato←modulation, after-touch, pitch bend.

(d) Crescendo, Diminuendo←velocity, expression, after-touch.

(e) Slur←note.

(f) Staccatissimo, Staccato, Mezzo-staccato, Tenuto←note.

In a normal saving operation, the user operates a save button ("Save") SB so that the MIDI-to-execution-icon conversion set SS, which is selected and edited on the screen, is updated and saved under a present name. In a new saving operation, the user operates a save as button ("Save As") AB so that the MIDI-to-execution-icon conversion set SS, which is selected and edited on the screen, can be additionally saved under a new name as a user set US. For example, the system provides prescribed procedures for "save as" as follows:

The user operates the save as button AB, so that a file dialogue (not shown) is open to allow entry of a file name. So, the user inputs a new file name and operates a save button (not shown) provided within the file dialogue. Thus, the edited MIDI-to-execution-icon conversion set is saved under a new conversion set name corresponding to the new file name. Thereafter, the saved MIDI-to-execution-icon conversion set is proposed as a new selectable conversion set for a new set selection operation of the user, so that it can be read out in the input/output selection area EA according to needs.

In a delete operation, the user operates a delete button ("Delete") DB, so that all data of the MIDI-to-execution-icon conversion set presently selected are deleted from the storage area. Thereafter, the deleted conversion set will not be read out in the input/output selection area EA even when the user performs a new set selection operation.

As described above, the present embodiment is designed to store plural MIDI-to-execution-icon conversion sets (SS) in advance. This provides an easy way for the user in set selection operation. In addition, the MIDI-to-execution-icon conversion sets can be arbitrarily selected and edited, hence, edit results can be saved as the user set US. Thus, the composer (i.e., user) is capable of arbitrarily selecting necessary types of MIDI data, which are needed for conversion to execution icons.

[F] Process of Conversion to Vibrato Icon

Figure 8:
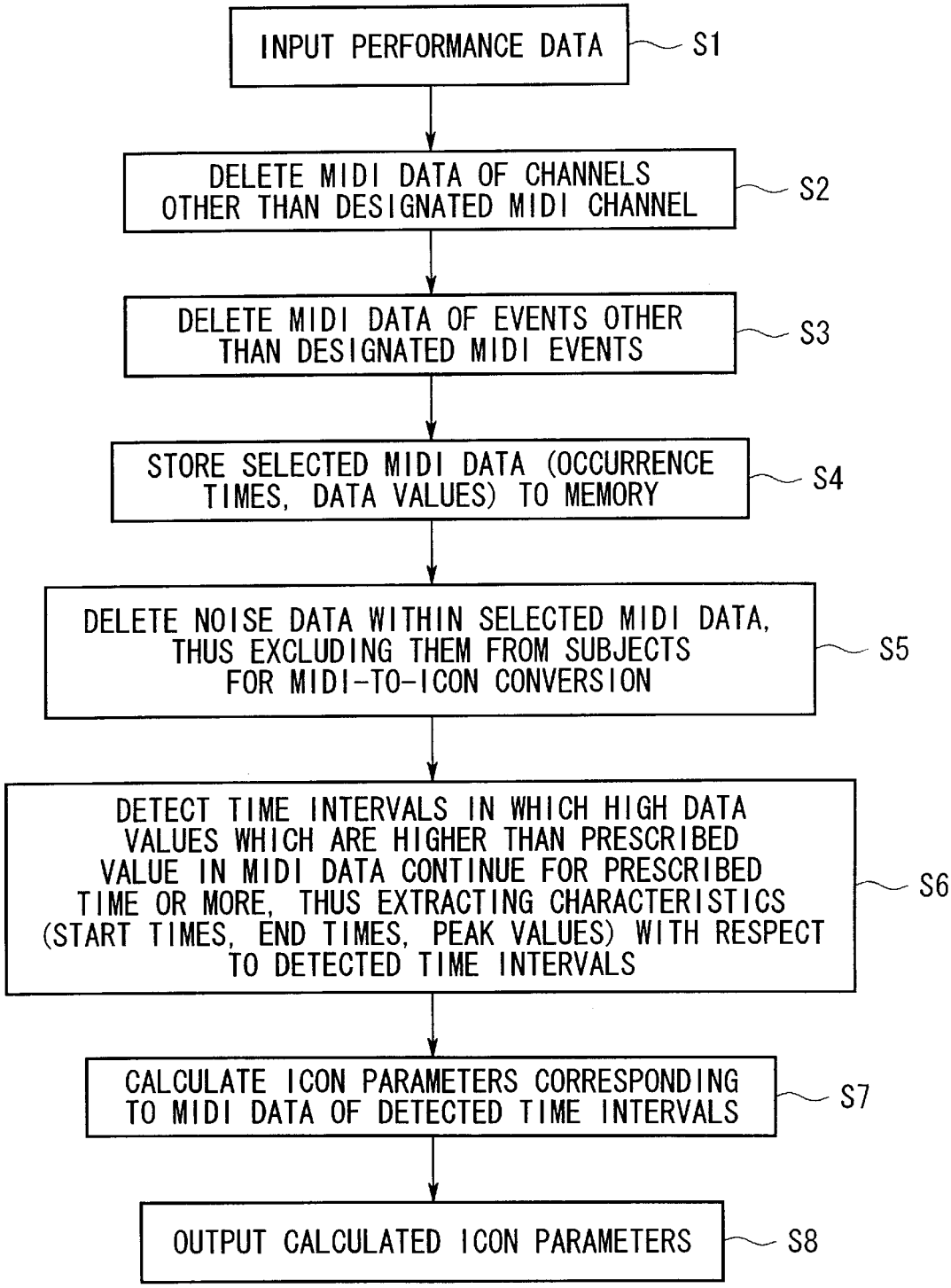
FIG. 8 is a flowchart showing a MIDI-to-icon conversion process in accordance with the embodiment of the invention.

FIG. 8 is a flowchart showing an example of a process of MIDI-to-icon conversion in accordance with the embodiment of the invention. This flowchart (or flow) is directed to the MIDI-to-icon conversion wherein a specific type of MIDI data corresponds to a modulation event which is being converted to a vibrato icon event in the performance data editing system of the present embodiment.

In this example, input modulation events are described by occurrence times and data values thereof, while vibrato icon events which are produced by the conversion are described by vibrato icon occurrence times and vibrato icon parameters. As the vibrato icon parameters, there are provided lengths, start times, start depths, first break-point times, first break-point depths, second break-point times, second break-point depths, . . . , n-th break-point times, n-th break-point depths and end depths.

Based on modulation events of MIDI data, a sound effect of vibrato is imparted to musical tones. In this case, normally, the sound source circuit 7 converts the modulation events to prescribed parameters such as vibrato depths (i.e., depths in pitch variations) and vibrato speeds (i.e., speeds in pitch variations). Thus, the vibrato is imparted to the musical tones based on the aforementioned parameters. In the MIDI-to-icon conversion of the present embodiment, parameters such as vibrato depths and vibrato speeds are produced as vibrato icon parameters based on modulation events. Incidentally, all the aforementioned parameters are not necessarily produced based on the modulation events, in other words, some parts of the parameters can be fixed at prescribed values or constant values which can be set again. The following description is made under a precondition that the vibrato speeds are fixedly set in advance while the vibrato depths are newly produced based on the modulation events. In addition, the present embodiment defines in advance certain characteristics in production of the vibrato depths being produced based on the modulation events. For example, the present embodiment defines in advance a value of the vibrato depth which is produced based on the modulation event having a maximal value of "127".

In FIG. 8, the flow firstly proceeds to step S1 which allows the user to input performance data. It is previously described that various methods can be employed for inputting the performance data. In this flow, for example, SMF data (hereinafter, referred to as "MIDI data") are newly read into the system. In step S2, the system uses a MIDI channel filter to delete MIDI data of unwanted channels (other than a designated MIDI channel) from the input MIDI data. Thus, it is possible to select MIDI data of only the designated MIDI channel from among the input MIDI data. In step S3, the system uses a MIDI message filter to further delete MIDI data of unwanted MIDI events (other than designated MIDI events) from the input MIDI data. Thus, it is possible to select MIDI data of only the designated MIDI events. According to the step S3, at least modulation events within MIDI messages are being selected or filtered. Thus, it is possible to obtain modulation occurrence times, data values and data attributes (data/noise) with respect to all modulation data which are read into the system.

In step S4, the selected MIDI data (e.g., modulation occurrence times, data values) which are selected from among the input MIDI data by the steps S2, S3 are stored in a prescribed memory area of the RAM 3. In step S5, the system deletes noise data (or data which are regarded as noise) from the selected MIDI data, so that the noise data are excluded from subjects for MIDI-to-icon conversion. In step S6, the system detects time sections in which high data values which are higher than a prescribed data value in the MIDI data continuously emerge for a prescribed time or more. So, the system extracts start times, end times and peak values with respect to the detected time sections respectively. In step S7, the system produces by calculations icon parameters (e.g., vibrato depths) which correspond to the MIDI data belonging to the detected time sections respectively. In step S8, the system outputs the calculated icon parameters.

Figure 9A:
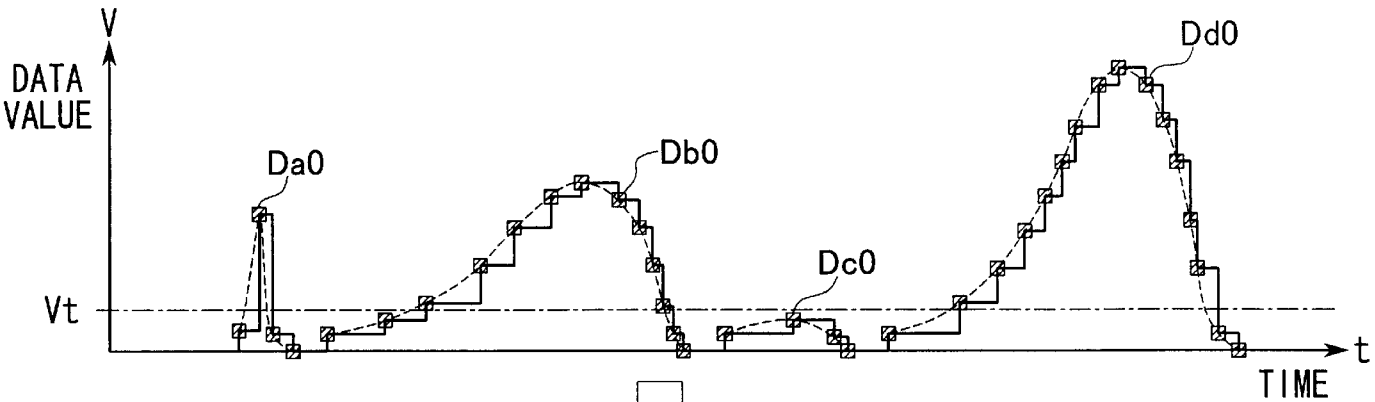
FIG. 9A is a graph showing modulation data strings which are subjected to level judgement process for elimination of noise components by using a data threshold Vt.
Figure 9B:
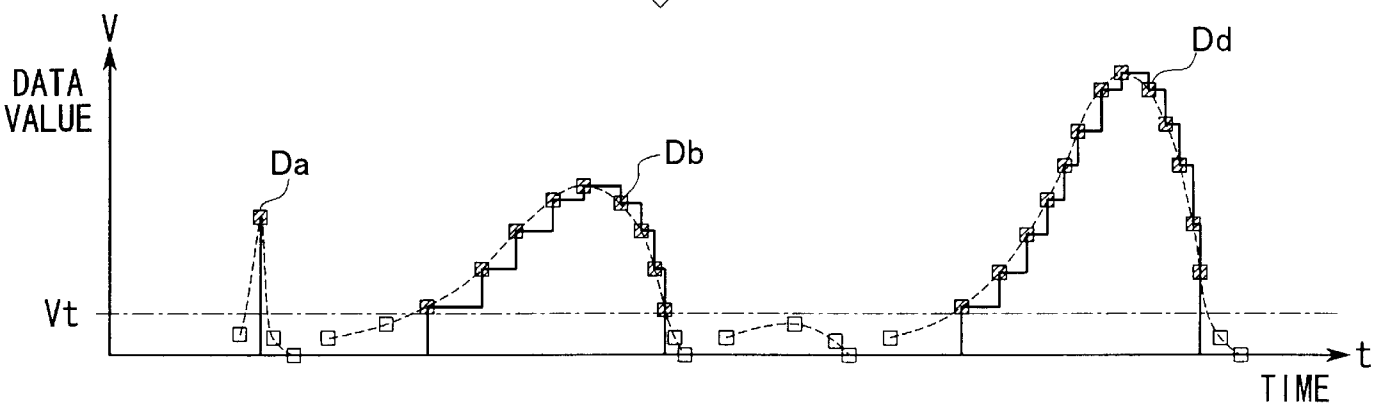
FIG. 9B is a graph showing a result of the level judgement process by which noise components are eliminated from the modulation data strings.

Next, a process for eliminating noise components from the MIDI data in step S5 will be described with reference to FIGS. 9A, 9B, 10A, 10B and 11. As described above, the modulation data are obtained from the input MIDI data (input by the step S1) by way of the steps S2 and S3. FIG. 9A shows modulation data which correspond to a data string containing data elements each indicated by a hatching-square symbol (i.e., a square symbol "≡" with hatching). Actually, FIG. 9A shows that the modulation data contain four data blocks Dao, Dbo, Dco and Ddo, each of which is drawn as a specific waveform having a peak. Now, a data threshold Vt corresponding to a prescribed data value is set for a level judgement process being performed on the modulation data of FIG. 9A. So, parts of the modulation data which are under the data threshold Vt are regarded as noise components, which are deleted and are excluded from conversion subjects to the MIDI-to-icon conversion. Herein, the data block Dco is entirely deleted. Due to the level judgement process, modulation data strings Da, Db and Dd (see FIG. 9B) containing data elements whose values are above the data threshold Vt are extracted from the modulation data. That is, as shown in FIG. 9B, the system discriminates from the modulation data the modulation data strings having data elements whose values are above the data threshold Vt and each of which is indicated by the hatching-square symbol, while the system excludes other data elements whose values are under the data threshold Vt and each of which is indicated by a blank-square symbol (i.e., "≡"). Thus, only the modulation data strings Da, Db and Dd are selected as subjects being converted to vibrato icons.

Figure 10A:
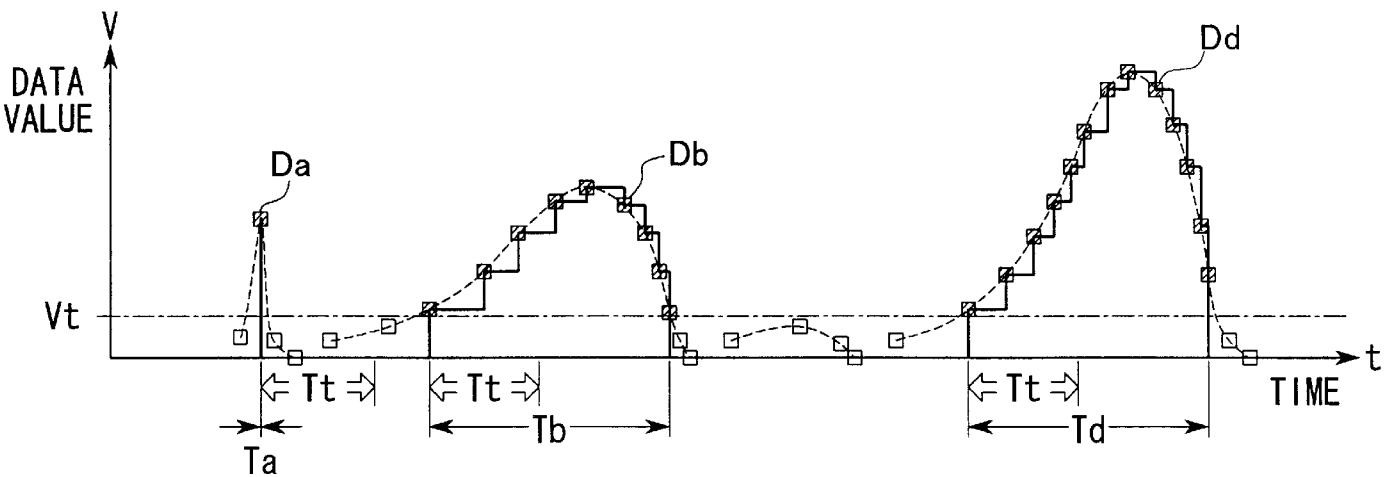
FIG. 10A is a graph showing noise-eliminated modulation data strings which are subjected to time judgement process for elimination of noise by using a time threshold Tt.
Figure 10B:
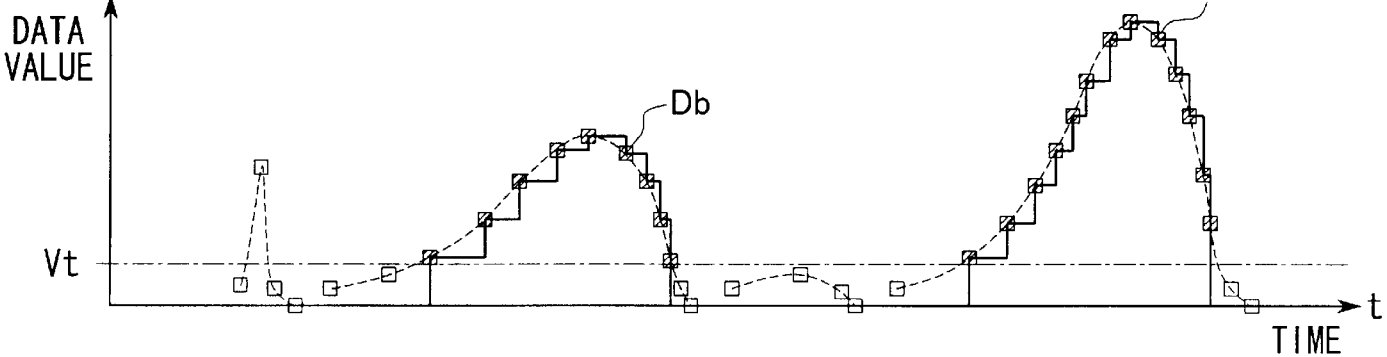
FIG. 10B is a graph showing a result of the time judgement process which extracts time-sustained modulation data strings.

Next, as shown in FIG. 10A, a time threshold Tt corresponding to a prescribed time length is set for a time judgement process being performed on the modulation data strings including the data elements whose values exceed the data threshold Vt. Herein, the modulation data string(s) which is not continuously sustained for the time threshold Tt or more are regarded as noise components, which are excluded from the conversion subjects of the MIDI-to-icon conversion. For example, the time judgement process is performed on the modulation data strings Da, Db and Dd containing the data elements whose values consecutively exceed the data threshold Vt and which have sustaining times Ta, Th and Td respectively. Herein, a decision is made as to whether each of the sustaining times Ta, Th and Td of the modulation data strings Da, Db and Dd is equal to or above the time threshold Tt or not. Due to the time judgement process, the modulation data string Da is deleted because it is regarded as noise in FIG. 10A. As a result, the system discriminates two modulation data strings Db and Dd which are sustained for the time threshold Tt or more and which contain the data elements being indicated by the hatching-square symbols in FIG. 10B. That is, the system narrows down the three modulation data strings to the two modulation data strings Db and Dd as the conversion subjects being converted to the vibrato icons.

Figure 11:
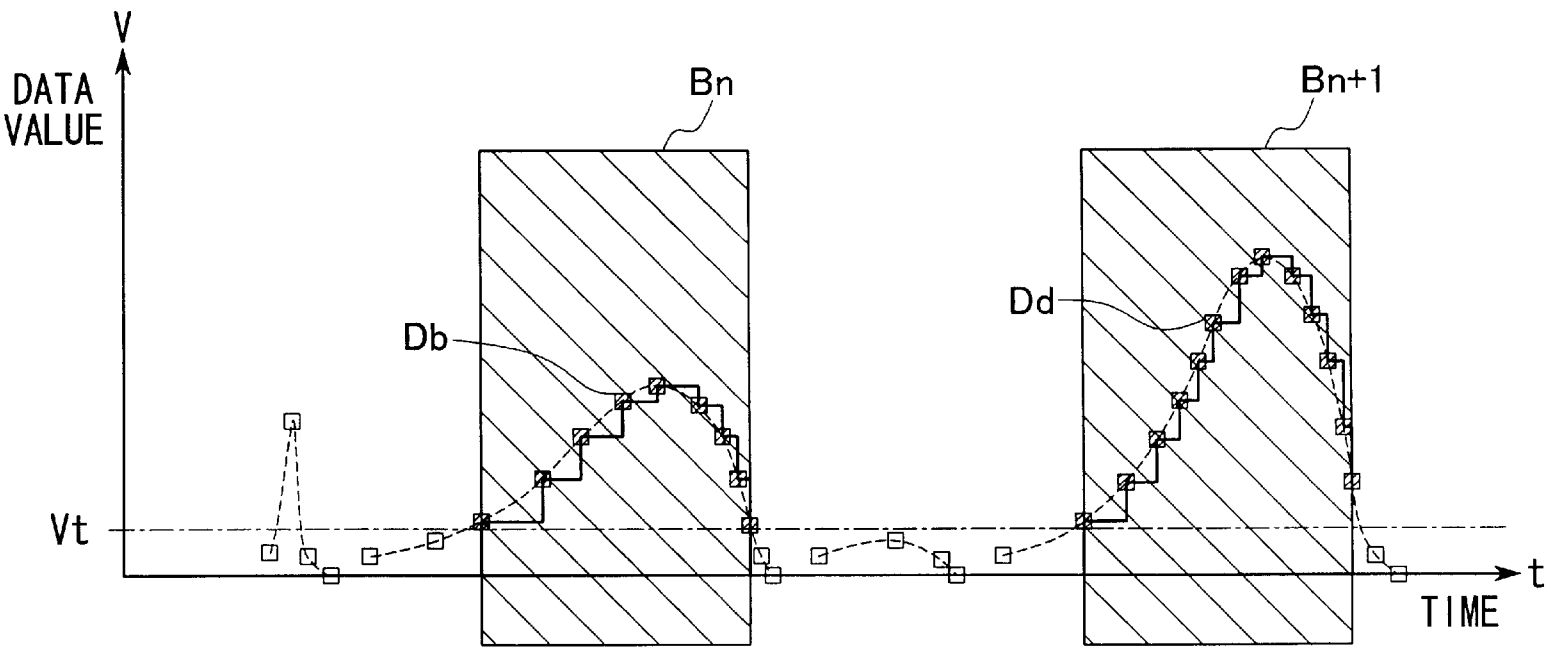
FIG. 11 is a graph showing modulation storage blocks which are set with regard to the extracted modulation data strings.

As described above, the system extracts all the modulation data strings from which the noise components are eliminated and each of which is formed by the consecutive data elements having finite values with respect to time. The extracted modulation data strings are temporarily stored in a prescribed memory area. Namely, as shown in FIG. 11, the modulation data strings Db and Dd are respectively stored as modulation storage blocks Bn and Bn+1.

Figure 12A:
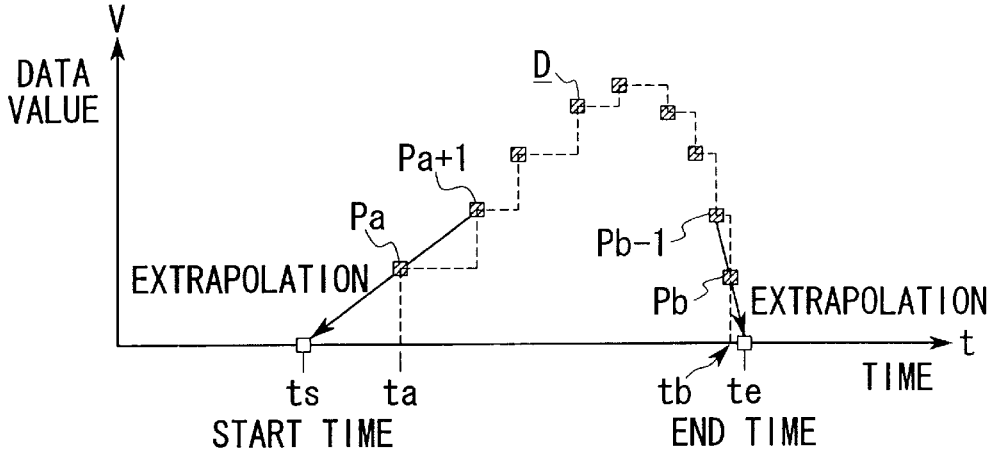
FIG. 12A is a graph showing a first example of extrapolation for calculating a modulation start time and a modulation end time with respect to a modulation data string D.
Figure 12B:
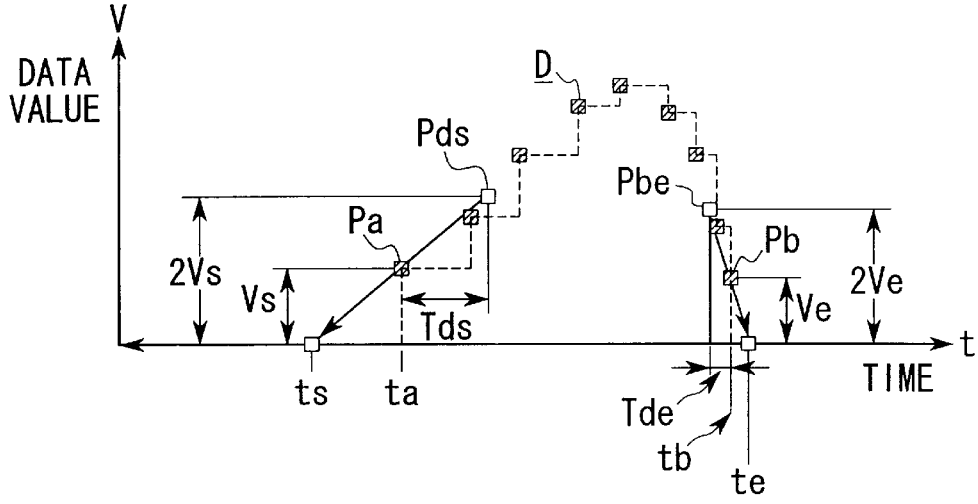
FIG. 12B is a graph showing a second example of extrapolation for calculating a modulation start time and a modulation end time with respect to the modulation data string D.

With reference to FIGS. 12A and 12B, a description will be given with respect to a characteristic extraction process of step S6 for extracting characteristics such as a start time and an end time from each time section containing data elements whose values are equal to or above the prescribed data value and which are consecutively sustained for a prescribed time or more. The characteristic extraction process deals with the modulation data blocks (e.g., Bn) containing "noise-eliminated" modulation data strings (each designated by a symbol "D") which are stored in the foregoing step S5. Herein, the characteristic extraction process extracts characteristics of the modulation data strings, which are stored again to update data. FIG. 12A shows an example of the modulation data string D containing data elements which are indicated by hatching-square symbols and which are defined between start-point data Pa and end-point data Pb. Herein, extrapolation is effected to determine two points of intersection at which extensions from Pa and Pb intersect with a zero level of an axis of "data value V". Those points of intersection are regarded as a modulation start time ts and a modulation end time te respectively. There is provided a terminal-added modulation data string De (see FIG. 13) which incorporates terminal data (designated by blank-square symbols) corresponding to the aforementioned times ts and te in addition to the data elements (designated by hatching-square symbols) of the modulation data string D. Thus, content of the modulation storage block (e.g., Bn) is updated and replaced with the terminal-added modulation data string De.

FIG. 12A shows a simple example of calculations for extrapolation. That is, extrapolation regarding the modulation start time ts is simply effected in response to a variation between the start-point data Pa and its adjacent point data Pa+1 in the modulation data string D, so that the system simply calculates the modulation start time ts. Similarly, extrapolation regarding the modulation end time te is simply effected in response to a variation between the end-point data Pb and its adjacent point data Pb−1 in the modulation data string D, so that the system simply calculates the modulation end time te.

FIG. 12B shows another example of calculations for extrapolation, wherein a modulation data string D contains data elements which are defined between start-point data Pa having a data value Vs and end-point data Pb having a data value Ve. With respect to extrapolation regarding the start-point data Pa, the system creates a dummy point Pds, which has a double data value 2Vs and which is located on a waveform of the modulation data string D in proximity to the start point Pa. Then, the system calculates a time interval Tds between the start point Pa and the dummy point Pds, so that a start time ts is set at a time point which precedes from a time ta of the start point Pa by the time interval Tds. With respect to extrapolation regarding the end-point data Pb, the system creats a dummy point Pde, which has a double data value 2Ve and which is located on the waveform of the modulation data string D in proximity to the end point Pb. Then, the system calculates a time interval Tde between the dummy point Pde and the end point Pb, so that an end time te is set at a time point which delays from a time tb of the end point Pb by the time interval Tde.

Figure 13:
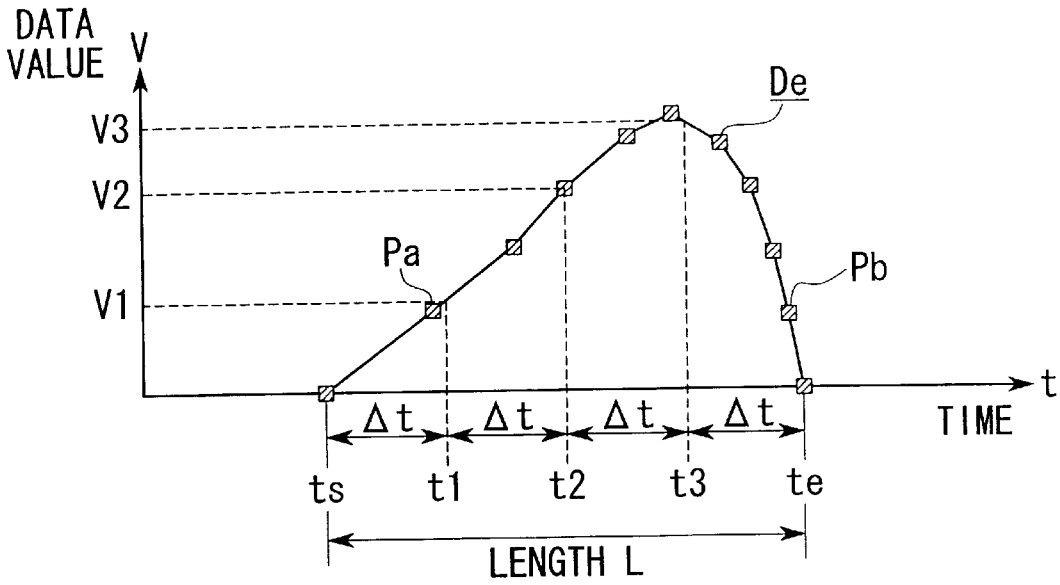
FIG. 13 is a graph showing a terminal-added modulation data string De incorporating terminal-point data elements corresponding to the modulation start time and modulation end time and which is used to explain calculations of icon parameters.

With reference to FIG. 13, a description will be given with respect to an icon parameter calculation process for calculating icon parameters of vibrato in response to MIDI data of each time interval in step S7. FIG. 13 shows an example of the terminal-added modulation data string De which is produced by the characteristic extraction process of step S6 and which incorporates the start-point data Pa and end-point data Pb in addition to the data elements (indicated by hatching-square symbols). In the icon parameter calculation process, a time interval L between the modulation start time ts and modulation end time te is regarded as a length of an icon parameter.

An overall waveform of the terminal-added modulation data string De defined between the start time ts and end time te is equally divided into "n" (where "n" is an integer arbitrarily selected) time sections, split time points of which are called break-point times. In FIG. 13, the length L between the times ts and te is equally divided into four time sections (i.e., n=4) using a prescribed time interval Δt, so that there are provided first, second and third break-point times t1, t2 and t3 which are disposed between the start time ts and end time te. Data values of the terminal-added modulation data string De at the break-point times t1, t2 and t3 are calculated by effecting linear interpolation on the MIDI data. In FIG. 13, first, second and third break-point data values V1, V2, V3 are respectively calculated using the linear interpolation being effected on the terminal-added modulation data string De with respect to the first, second and third break-point times t1, t2, t3. In accordance with the aforementioned characteristics, the system calculates break-point depths from the break-point data values V1, V2, V3 as icon parameters.

This invention is not necessarily limited to the present embodiment which is described heretofore to provide a specific conversion algorithm for converting the tune data to the execution-related data and a specific format of the execution-related data, which are merely examples.

As the format of the performance data, it is possible to employ a variety of methods, as follows:

(1) A first method corresponding to "event plus relative time", in which an occurrence time of a performance event is represented by a time that elapses from occurrence of a preceding performance event.

(2) A second method corresponding to "event plus absolute time", in which an occurrence time of a performance event is represented by an absolute time in a tune or measure.

(3) A third method corresponding to "pitch (rest) plus length", in which performance data is represented by a pitch of a note and its characteristic or a rest and its length.

(4) A fourth method corresponding to "solid method", in which each of memory areas is secured by minimum resolution of performance so that a performance event is stored in the memory area corresponding to an occurrence time thereof.

In addition, automatic performance data of plural channels can be stored in a channel-mixture manner that data of the plural channels are mixed without sorting or alignment in storage or in a channel-independence manner that data of each channel is stored on its corresponding track in storage.

Further, memory management is made such that time-series performance data are stored in consecutive areas, or multiple data stored in different areas which are arranged at intervals are collectively managed as consecutive data. In short, the present embodiment requires that performance data can be managed as time-series consecutive data on the memory. So, the present embodiment does not put a question as to whether the performance data are stored in the memory consecutively or not.

As described heretofore, this invention has a variety of effects and technical features, which are summarized as follows:

(1) The performance data editing system of this invention is designed to extract data portions which should be converted to execution-related data within input performance data, so that the extracted data portions are solely converted to the execution-related data. Namely, the system has a capability of converting only selected parts of the normal performance data to execution-related data. In other words, it is possible to convert only necessary parts of the performance data, which are supplied to the execution-related sound source(s), to the execution-related data. Thus, it is possible to efficiently convert the normal performance data to the execution-related performance data with simple operations.

(2) The performance data editing system incorporates a data type designator that designates specific types of tune data which should be converted to the execution-related data within the input performance data, so that the designated types of the tune data within the input performance data are solely converted to the execution-related data. In other words, the system has a capability of converting only the selected tune data representative of specific types of events within the normal performance data to the execution-related data. This eliminates possibilities in that unwanted data are mistakenly converted to execution-related performance data. In addition, the data type designator also designates relationships between the specific types of data and their corresponding execution-related data which are produced by conversion effected on the specific types of data. Thus, it is possible to efficiently convert the normal performance data to the execution-related performance data with simple operations.

(3) The performance data editing system stores in advance plural sets of conversion rules with regard to conversion in which specific types of tune data are correspondingly converted to execution-related data, wherein the data type designator designates any one of the conversion rules being actually used for the conversion. In addition, the system also has an editor for editing or changing contents of the conversion rules stored in a storage. Namely, there are provided plural sets of conversion sets for conversion of "(tune data)→(execution-related data)", any one of which can be arbitrarily selected. So, it is possible to easily change or edit the conversion rules for conversion of "(tune data)→(execution-related data)". This allows the conversion rules to flexibly respond to a variety of conditions. Thus, it is possible to actualize desired methods of conversion which the composer prefers to.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to be embraced by the claims.

What is claimed is:

1. A performance data editing method comprising steps of:

inputting performance data including a note event;

extracting a part of the input performance data; and converting the extracted part of the input performance data to execution-related data, wherein the execution-related data contain the note event and an execution icon event, and wherein the execution icon event contains identification information for specifying an execution icon in a musical score to be displayed on a screen of a display, and control information for controlling articulation to be imparted to the note event contained in the performance data.

2. A performance data editing method according to claim 1 wherein the performance data are configured by a plurality of channels, so that the extracted part of the input performance data corresponds to one of the plurality of channels.

3. A performance data editing method according to claim 1 wherein the part of the input performance data being extracted corresponds to a certain time section of the input performance data.

4. A performance data editing method according to claim 1 further comprising the steps of:

supplying the execution-related data to an execution-related sound source; and supplying a remaining part of the input performance data excluding the extracted part to another sound source.

5. A performance data editing method comprising the steps of:

inputting performance data having plural types of events including a note event;

designating a specific type of event within the input performance data;

extracting the specific type of event from the input performance data; and converting the extracted specific type of the event to an execution icon event, wherein the execution icon event contains identification information for specifying an execution icon in a musical score to be displayed on a screen of a display, and control information for controlling articulation to be imparted to the note event included in the performance data.

6. A performance data editing method according to claim 5 further comprising the step of:

selecting one of plural sets of conversion rules, which are stored in advance in a storage and are used for converting the specific types of events to execution icon events, so that the extracted specific type of event is converted to the execution icon event in accordance with the selected one of the conversion rules.

7. A performance data editing method according to claim 6 further comprising the step of:

editing each of the plural sets of conversion rules.

8. A performance data editing method according to claim 5 wherein the performance data correspond to MIDI data, which differ with respect to each of tone colors.

9. A performance data editing method according to claim 5 wherein the performance data further includes a pitch bend event, a modulation event, an expression event, and an after-touch event, and wherein the specific type of event designated within the input performance data is selected from said note event, pitch bend event, modulation event, expression event, and after-touch event.

10. A performance data editing method according to claim 5, further comprising the step of producing execution-related data including the execution icon event and the note event to which the articulation is imparted based on the control information included in the execution icon event.

11. A performance data editing method comprising the steps of:

inputting performance data corresponding to MIDI data which are configured by a plurality of channels and contain specific types of data in connection with prescribed musical parameters such as attack, release, modulation and accent-plus-duration;

extracting at least a part of the input performance data with respect to at least one of a channel, a specific type and a time section;

selecting at least one of plural sets of conversion rules which are stored in advance;

converting the extracted part of the input performance data to execution-related data in accordance with the selected set of the conversion rules; and delivering the execution-related data to an execution-related sound source while delivering a remaining part of the input performance data excluding the extracted part to another sound source.

12. A performance data editing method according to claim 11 wherein prescribed executions are collected as layers in connection with the prescribed musical parameters respectively, so that the performance data are subjected to conversion to a group of executions belonging to each of the layers in accordance with the selected set of the conversion rules.

13. A performance data editing method according to claim 11 further comprising the steps of:

editing a filtering process for extracting at least a part of the input performance data; and editing the selected set of the conversion rules.

14. A performance data editing apparatus comprising:

a performance data input for inputting performance data including a note event;

a part extractor for extracting at least a part of the input performance data; and a converter for converting the extracted part of the input performance data to execution-related data, wherein the execution-related data contain the note event and an execution icon event, and wherein the execution icon event contains identification information for specifying an execution icon in a musical score to be displayed on a screen of a display, and control information for controlling articulation to be imparted to the note event contained in the performance data.

15. A performance data editing apparatus comprising:

a performance data input for inputting performance data having plural types of events including a note event;

a data type designator for designating a specific type of event within the input performance data;

an extractor for extracting the specific type of event from the input performance data; and a converter for converting the extracted specific type of the event to an execution icon event, wherein the execution icon event contains identification information for specifying an execution icon in a musical score to be displayed on a screen of a display, and control information for controlling articulation to be imparted to the note event included in the performance data.

16. A performance data editing apparatus comprising:

a performance data input for inputting performance data corresponding to MIDI data which are configured by a plurality of channels and contain specific types of data in connection with prescribed musical parameters- such as attack, release, modulation and accent-plus-duration;

a part extractor for extracting at least a part of the input performance data with respect to at least one of a channel, a specific type and a time section;

a set selector for selecting at least one of plural sets of conversion rules which are stored in advance;

a converter for converting the extracted part of the input performance data to execution-related data in accordance with the selected set of the conversion rules; and a deliverer for delivering the execution-related data to an execution-related sound source while delivering a remaining part of the input performance data excluding the extracted part to another sound source.

17. A machine-readable media storing programs and data that cause a computer to perform a performance data editing method comprising the steps of:

inputting performance data including a note event;

extracting a part of the input performance data; and converting the extracted part of the input performance data to execution-related data, wherein the execution-related data contain the note event and an execution icon event, and wherein the execution icon event contains identification information for specifying an execution icon in a musical score to be displayed on a screen of a display, and control information for controlling articulation to be imparted to the note event contained in the performance data.

18. A machine-readable media storing programs and data that cause a computer to perform a performance data editing method comprising the steps of:

inputting performance data having plural types of events including a note event;

designating a specific type of event within the input performance data;

extracting the specific type of event from the input performance data; and converting the extracted specific type of the event to an execution icon event, wherein the execution icon event contains identification information for specifying an execution icon in a musical score to be displayed on a screen of a display, and control information for controlling articulation to be imparted to the note event included in the performance data.

19. A machine-readable media storing programs and data that cause a computer to perform a performance data editing method comprising the steps of:

inputting performance data corresponding to MIDI data which are configured by a plurality of channels and contain specific types of data in connection with prescribed musical parameters such as attack, release, modulation and accent-plus-duration;

extracting at least a part of the input performance data with respect to at least one of a channel, a specific type and a time section;

selecting at least one of plural sets of conversion rules which are stored in advance;

converting the extracted part of the input performance data to execution-related data in accordance with the selected set of the conversion rules; and delivering the execution-related data to an execution-related sound source while delivering a remaining part of the input performance data excluding the extracted part to another sound source.

* * * * *